US005178601A

United States Patent [19]

Lovenbrant

[11] Patent Number: 5,178,601

[45] Date of Patent: Jan. 12, 1993

[54] APPARATUS FOR FOLDING AN EDGE ON A CONTINUOUS MATERIAL WEB

[75] Inventor: Jan Lovenbrant, Lomma, Sweden

[73] Assignee: Tetra Alfa Holdings S.A., Pully, Switzerland

[21] Appl. No.: 637,552

[22] Filed: Jan. 4, 1991

[30] Foreign Application Priority Data

Jan. 16, 1990 [SE] Sweden ..... 9000153-8

[51] Int. Cl.[5] ..... B65H 45/22; B65B 9/20

[52] U.S. Cl. ..... 493/423; 493/394

[58] Field of Search ..... 493/134, 142, 178, 179, 493/394, 423, 441

[56] References Cited

U.S. PATENT DOCUMENTS

| | | | |
|---|---|---|---|
| 1,506,844 | 9/1924 | La Bonbard et al. | 493/179 |
| 3,073,217 | 1/1963 | Spalding et al. | 493/55 |
| 3,229,596 | 1/1966 | Hottendorf | 493/179 |
| 3,701,522 | 10/1972 | Chi | 493/423 |
| 3,716,435 | 2/1973 | Jensen et al. | 493/287 |
| 4,614,512 | 9/1986 | Capdeboscq | 493/423 |
| 4,648,336 | 3/1987 | Ragnebring | 493/423 |
| 4,708,708 | 11/1987 | Fries | 493/60 |
| 4,795,416 | 1/1989 | Cogswell et al. | 493/423 |

FOREIGN PATENT DOCUMENTS

| | | |
|---|---|---|
| 3118886A1 | 2/1982 | Fed. Rep. of Germany . |
| 1359498 | 7/1974 | United Kingdom . |

*Primary Examiner*—William E. Terrell

*Attorney, Agent, or Firm*—Burns, Doane, Swecker & Mathis

[57] ABSTRACT

An apparatus for folding an edge (11) of a continuous web (10) is disclosed, wherein the continuous web (10) is held against a belt (1) which is twisted through substantially 180° between two wheels (2, 3) to fold over the edge (11) during the twisting action. The belt (1), which is endless, runs over two other wheels (4, 5) in order to return to the wheels (2, 3).

2 Claims, 4 Drawing Sheets

APPARATUS FOR FOLDING AN EDGE ON A CONTINUOUS MATERIAL WEB

BACKGROUND OF THE INVENTION

1. Field of the Invention

The present invention relates to folding apparatuses, and more particularly to apparatuses for folding an edge on a continuous material web.

2. Description of Related Art

The material which is employed for disposable packages for liquid foods such as milk or juice normally consists of a paper or cardboard layer which is laminated on both sides with a thermoplastic. The laminate may occasionally also include a thin aluminium foil.

After production of the laminate, this is cut in suitable widths and formed into packages in a filling machine. The point of departure for this operation is that the packaging material supplied from a roll is formed into a tube which is transversely sealed and then cut in the transverse seals, in order finally to be formed into the finished package.

Since the longitudinal joint is sealed in that the two edges overlap one another so that the material web becomes a tube, the edge located inside the tube must be protected in some manner so that the filled contents do not come into direct contact with the paper layer in the laminate. Otherwise, this could result in the contents wetting the paper layer and, in aseptic packages or cartons, such a joint would give rise to a lack of sterility.

Normally, the inner longitudinal edge is protected by a loose strip which is sealed against the outer thermoplastic layer in the laminate. It is also possible, in production of the laminate, to allow a narrow edge of thermoplastic, possibly laminated with aluminium foil, to protrude outside the edge of the packaging material proper.

Such an edge of thermoplastic, possibly with adhering aluminium foil, must, before arrival of the packaging material at the filling machine, be folded over the open laminate edge in order thereby to protect this edge. This, this operation is presently carried out in a manner such that the edge is heated by hot air or by an IR lamp and is then folded by means of a number of rollers which are at different angles of inclination. Such an apparatus provides for adequate folding. However, friction is great and only limited output capacity is possible. Moreover, prior art apparatuses are also complex and contain many moving parts. Such an apparatus is described in U.S. Pat. No. 4,606,784.

OBJECTS AND SUMMARY OF THE INVENTION

One object of the present invention is to provide an apparatus for folding an edge on a continuous material web, wherein the apparatus has no or insignificant friction and, therefore, is capable of operation at high speed.

A further object of the present invention is to provide an apparatus which is relatively simple and economical.

The above objects as well as other objects not specifically enumerated are accomplished by an apparatus in accordance with the present invention for holding an edge of a continuous material web. The apparatus of the present invention for folding an edge of a continuous material web includes at least two wheels, an endless driven belt running from one of the wheels to the other of the wheels, wherein a length of the belt between the wheels is twisted substantially 180 degrees, and means for holding the edge of the material web against at least a portion of the length of the belt such that the length folds the edge as the length twists over at least a portion of the 180 degrees.

BRIEF DESCRIPTION OF THE ACCOMPANYING DRAWINGS

The nature of the present invention and its objects will be more readily understood from the accompanying drawing, wherein like members bear like reference numbers, and wherein.

FIG. 1 is a top plan view of the apparatus according to the present invention;

DESCRIPTION

Referring to FIGS. 1–7, the apparatus according to the present invention includes a belt 1, of rectangular or trapezoidal cross-section. The belt runs over at least four wheels 2, 3, 4 and 5 which are preferably designed as conventional belt pulleys but may also be designed without grooves.

Figure 2:
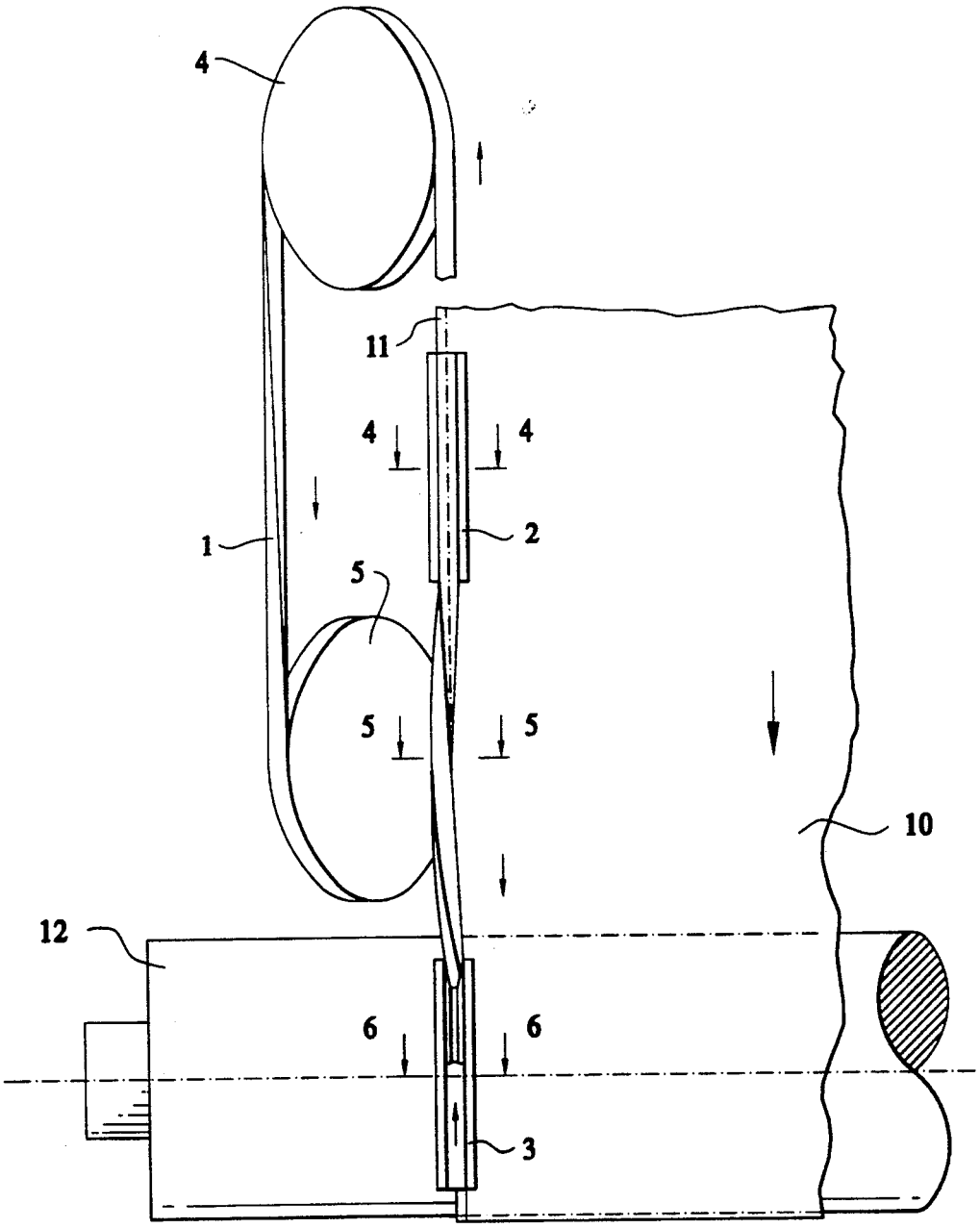
FIG. 2 is a side elevational view of the apparatus of FIG. 1.
Figure 2:
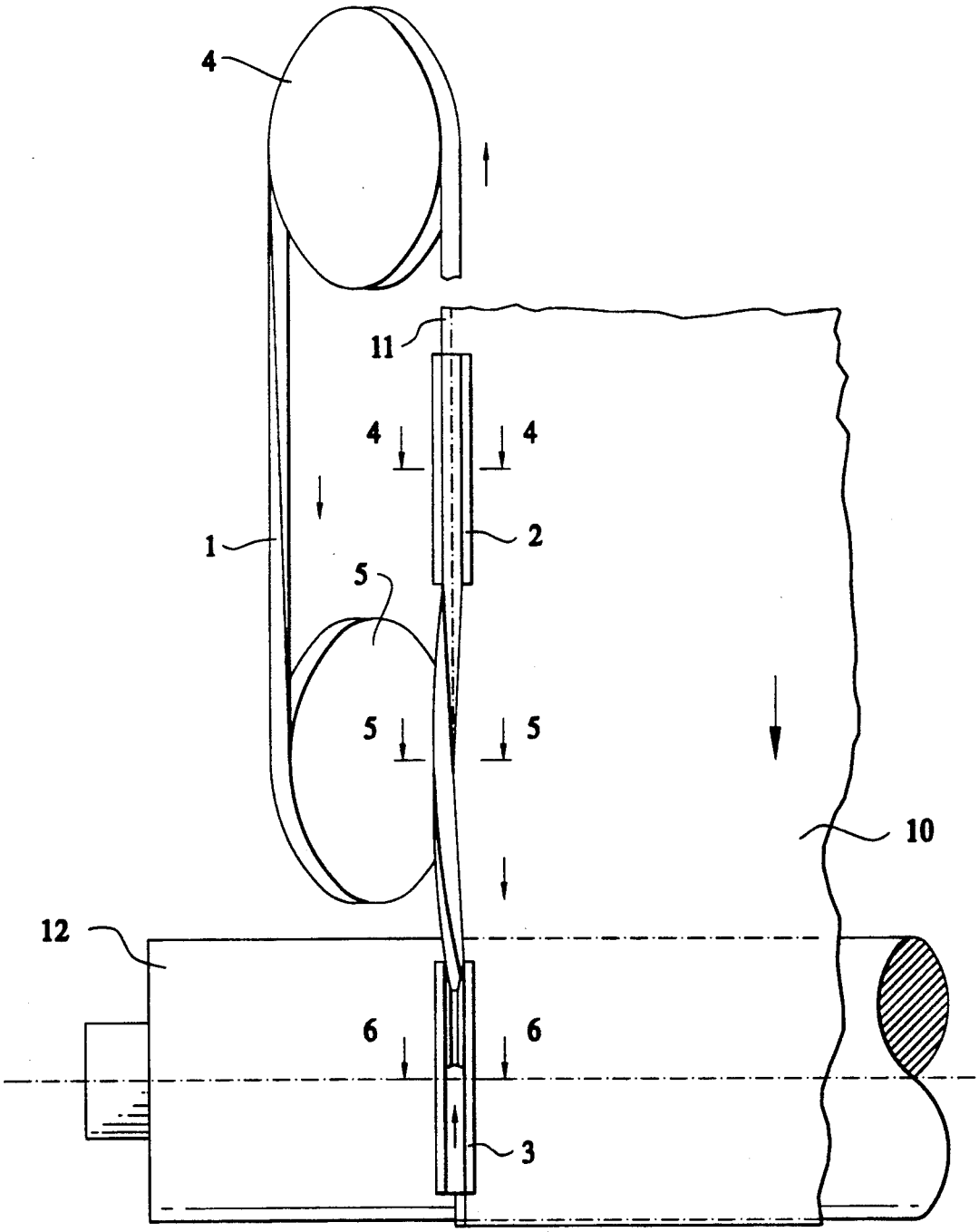
Figure 3:
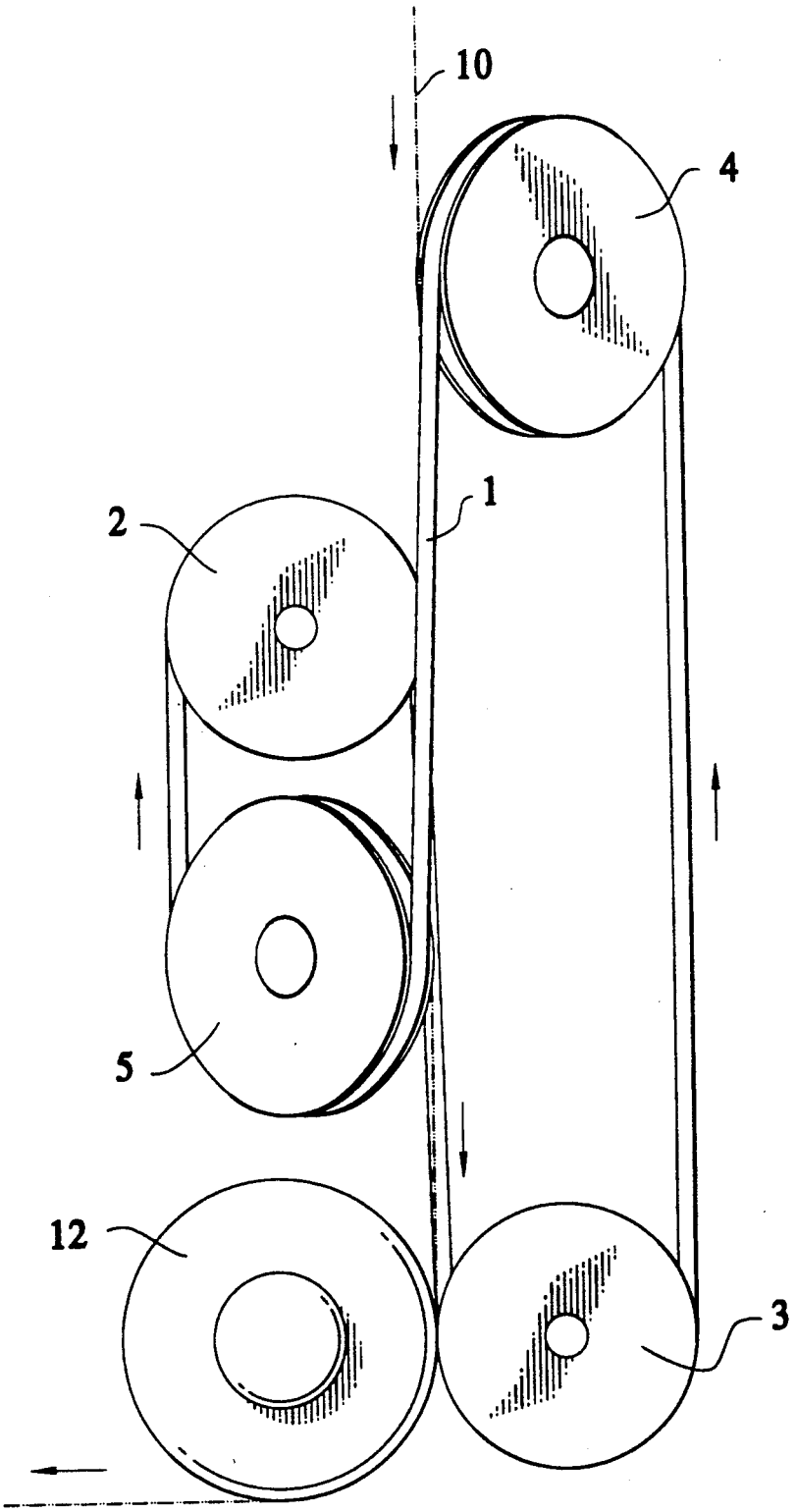
FIG. 3 is an end elevational view of the apparatus of FIG. 1.

As shown in FIG. 2 the belt 1 runs from the wheel 2, twists through 180° before reaching the wheel 3, runs about the wheel 3 passes to the wheel 4, and runs down over the wheel 5 and back to the wheel 2.

In order to return the belt 1 after the twisting operation, the wheels 4 and 5 must be inclined in relation to the wheels 2 and 3, which is clearly apparent from FIG. 1. However, FIG. 1 shows only the shafts 6, 7, 8 and 9, respectively, of the wheels, 2, 3, 4 and 5. The center line of the belt 1 determines the design and thereby also determines the size of the wheels, for which reason the wheels 4 and 5 will of necessity be somewhat larger than the wheels 2 and 3. In the preferred embodiment, the wheels 2 and 3 are disposed in the same plane, while the wheels 4 and 5 are disposed at an angle in relation to the common plane of the wheels 2 and 3. The direction of movement of the belt is shown by arrows in FIG. 3.

A continuous material web 10 is led through the apparatus, wherein the web has a projecting edge 11 along one laterally defining line of the web 10. The edge 11 of the continuous material web is in contact with the belt 1 for the greater part of that distance in which the belt 1 is twisted through 180°, i.e. between the wheels 2 and 3. Thereafter, the continuous material web 10 reaches a roller 12 which, in this embodiment, serves both as squeezer for the inwardly folded edge 11 and as return roller for the continuous material web 10. Naturally, two different rollers may be provided for both of these purposes.

The belt 1 may be of rubber, plastics or the like, possibly reinforced or strengthened with cord, with at least one planar face 13 against which the edge 11 is to be folded. In the preferred embodiment, the belt 1 is of trapezoidal cross-section. The planar face 13 against which the edge 11 is folded should be at least twice as wide as that edge 11 on the continuous material web 10 which is to be folded.

The belt 1 is driven at the same speed as the continuous material web 10. Driving of the belt 1 (not shown) is provided in a suitable manner by means of, for instance, an electric motor, via one of the wheels.

The active part of the belt 1 which is in contact with the continuous material web 10 and which executes the folding operation proper is that part between the wheels 2 and 3 where the belt 1 twists through 180°. This part should be as short as possible, in order that the belt will not be capable of moving laterally when it folds the edge 11. If the belt is unstable in this part, there is the risk of a resultant uneven folding which does not tightly enclose the material web 10. It is also possible to solve this problem by providing the apparatus with guide rollers (not shown) for the belt and the material web. Consequently, it is vitally important to keep the belt taut, so the apparatus should be provided with some form of tensioning screw or the like (not shown).

The total length of the belt 1 may vary, but the inactive part of the belt 1 constitutes a cooling facility for the slight frictional heat which occurs in the active part, for which reason the belt may be long, as long as it does no task up too much space.

In the preferred embodiment, the apparatus is oriented such that the material web 10 moves vertically through the apparatus and the active part of the belt 1 is thereby also vertically oriented. However, it is fully possible to orient the web and, thereby also the apparatus proper, horizontally.

Figure 4:
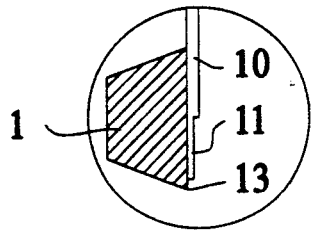
FIG. 4 is a cross-sectional view of the apparatus along line C—C in FIG. 2.
Figure 5:
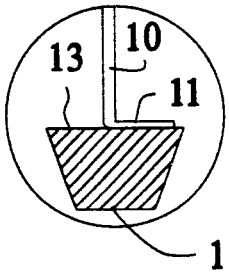
FIG. 5 is a cross-sectional view of the apparatus along line D—D in FIG. 2.
Figure 6:
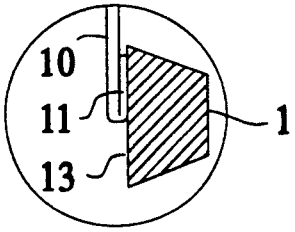
FIG. 6 is a cross-sectional view of the apparatus along line E—E in FIG. 2.

FIGS. 4 to 6 show three different cross-sections through the active part of the belt 1, where the planar face 13 of the belt against which the edge 11 is folded is twisted through 180° from section line CC to section line EE. When the continuous material web 10 first comes into contact with the belt 1, the projecting edge 11 constitutes an extension of the material web (FIG. 4). In FIG. 5, the belt has half-completed its twisting, and hence, the planar face 13 and therewith the projecting edge 11 have turn 4 through 90°. In FIG. 6, both twisting of the belt and folding of the edge have been completed and the planar face 13 of the belt 1 is now oriented at 180° from the starting position.

Figure 7:
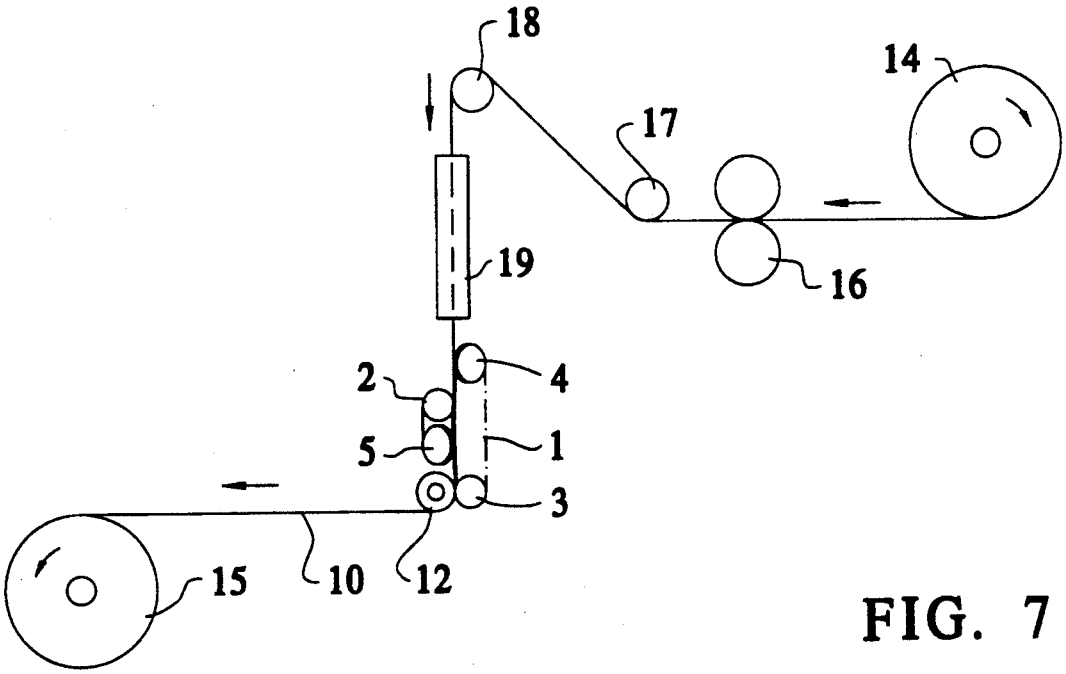
FIG. 7 is a schematic view of a web handling apparatus which includes the apparatus of FIG. 1.

FIG. 7 shows how the apparatus according to the present invention may be integrated into a web handling apparatus in which the continuous material web, from a magazine reel 14 where the edge 11 of the material web 10 projects straight out, is processed through the plant until it reaches a new magazine reel 15 where the projecting edge 11 is folded in and sealed against the material web 10.

From the magazine reel 14, the material web 10 moves between the nip of a pair of rollers 16, of which one is provided with a projecting ridge. The material web is guided through the roller pair 16 such that the ridge impinges on the material web 10 slightly inside the projecting edge 11 and thereby presses together the material web 10, at least as much as it corresponds to the width of the projecting edge 11, since the folded edge would otherwise "build up" the one side of the web and render winding-up of the web impossible.

From the roller pair 16 via the return rollers 17 and 18, the material web 10 moves vertically downwards. Just before folding of the edge takes place, the outermost portion of the material web against which the edge is to be sealed is heated. A suitable heating unit 19 which utilizes hot air or IR light is disposed along the edge of the material web and heats the web to a temperature at which the thermoplastic melts. Thereupon, the web 10 reaches the apparatus according to the present invention for folding the edge 11, wherein the belt 1 folds over the projecting edge 11. Once the edge 11 is folded, the material web reaches the roller 12, which acts as both a return roller and a counter-pressure roller or squeezer, which seals the edge 11 against the heated material web 10. The material web 10 is then ready for renewed winding-up on a new magazine reel 15.

Instead of sealing with the aid of the thermoplastic on the surface of the material web 10, it is possible to supply a binder to the material web before the edge is folded over.

As will have been apparent from the above description, the present invention provides a simple and economical apparatus for folding of one edge on a continuous material web, the apparatus being capable of achieving high output capacity and suffering from no or insignificant friction.

Also, the apparatus according to the present invention is relatively insensitive to any possible joints in the continuous material web, since there is a certain resilience in the belt so that the bolt may move slightly when a joint passes through the apparatus.

While this invention has been illustrated and described in accordance with a preferred embodiment, it is recognized that variations and changes may be made therein without departing from the invention as set forth in the claims.

What is claimed is:

1. Apparatus for folding an edge of a continuous material web, said apparatus comprising:

means for guiding a continuous material web along a substantially planar path, said web having a lateral edge;

a plurality of wheels mounted for rotation adjacent the edge of said path;

an endless belt mounted on said wheels and said belt having a planar face;

means for advancing said belt at substantially the same speed as the material web;

said wheels being positioned for guiding said belt along first, second, third, and fourth segments in sequence; said first belt segment extending along said edge path with said belt face aligned with said web planar path and turning said belt face in a first rotational direction through 180°; said second belt segment extending in spaced relation to the edge of said web and advancing in a direction opposite to said first segment; said third belt segment extending, in a spaced relation, along said edge path, said belt face turning in the rotational direction opposite to the first rotational direction; said fourth segment extending in a spaced relation to the edge of said web and advancing in a direction opposite to said first segment and turning said belt face in a rotational direction opposite to the first rotational direction; the belt being turned, in the second, third, and fourth segments, in the rotational direction opposite to the first rotational direction through 180 °;

whereby the planar face of the belt turns the edge of the continuous web through 180° as the web and belt advance together.

2. The apparatus according to claim 1 wherein said first belt segment extends between first and second ones of said wheels, said second belt segment extends between said second wheel and a third one of said wheels, said third belt segment extends between said third and a fourth one of said wheels and said fourth belt segment extends between said fourth wheel and said first wheel.

* * * * *